US006769164B2

(12) United States Patent
Zubcevic

(10) Patent No.: US 6,769,164 B2
(45) Date of Patent: Aug. 3, 2004

(54) METHOD AND AN APPARATUS FOR CAN MAKING

(75) Inventor: Esad Zubcevic, Vejle (DK)

(73) Assignee: Glud & Marstrand A/S, Losning (DK)

( * ) Notice: Subject to any disclaimer, the term of this patent is extended or adjusted under 35 U.S.C. 154(b) by 134 days.

(21) Appl. No.: 10/168,481

(22) PCT Filed: Dec. 20, 2000

(86) PCT No.: PCT/DK00/00730

§ 371 (c)(1),
(2), (4) Date: Sep. 5, 2002

(87) PCT Pub. No.: WO01/47653

PCT Pub. Date: Jul. 5, 2001

(65) Prior Publication Data

US 2003/0074943 A1 Apr. 24, 2003

(51) Int. Cl.[7] ..... B21D 39/00; B21D 11/10; B21D 51/28

(52) U.S. Cl. ..... 29/509; 29/796; 72/379.4; 413/73; 413/77

(58) Field of Search ..... 29/509, 510, 511, 29/773, 788, 796, 283.5, 243.58, 243.517, 243.5, 514; 413/69, 70, 71, 72, 73, 74, 75, 76, 77; 72/298, 311, 379.2, 51

(56) References Cited

U.S. PATENT DOCUMENTS

| | | | | | |
|---|---|---|---|---|---|
| 1,857,325 | A | | 5/1932 | Ottenstein | |
| 1,888,413 | A | * | 11/1932 | Sebell | 29/458 |
| 2,078,546 | A | * | 4/1937 | Sebell | 413/69 |
| 2,337,901 | A | * | 12/1943 | Krueger | 413/77 |
| 2,883,956 | A | * | 4/1959 | Nordquist | 413/69 |
| 3,217,522 | A | | 11/1965 | Malmede | |
| 3,759,203 | A | | 9/1973 | Frankenberg | |
| 4,226,201 | A | * | 10/1980 | Takahashi et al. | 413/71 |
| 4,719,329 | A | * | 1/1988 | Matsuno et al. | 413/77 |
| 5,209,625 | A | * | 5/1993 | Stieger | 413/72 |
| 5,722,149 | A | * | 3/1998 | Lesage et al. | 413/75 |
| 5,727,414 | A | * | 3/1998 | Halasz et al. | 72/379.4 |

FOREIGN PATENT DOCUMENTS

| | | |
|---|---|---|
| DE | 66860 | 2/1893 |
| DE | 448378 | 8/1927 |
| DE | 2260475 | 6/1974 |
| JP | 7-100543 | 4/1995 |

OTHER PUBLICATIONS

International Search Report, PCT/DK00/00730, Jun. 26, 2001.

* cited by examiner

*Primary Examiner*—David P. Bryant
(74) *Attorney, Agent, or Firm*—Harness Dickey

(57) ABSTRACT

A method and an apparatus for making cans from three pieces of a sheet metal, namely a bottom part, a body part and a closure, the method and apparatus enabling cost efficient production of cans in small batch sizes. The apparatus has means for forming a tubular can body from a blank of sheet material without internally supporting the tubular form. The apparatus further has means for subsequently forming the tubular can body into a cross sectional shape without the use of a dedicated press tool, means for beading, curling and flanging the can body and means for attaching the bottom part and the closure to the can body.

22 Claims, 9 Drawing Sheets

METHOD AND AN APPARATUS FOR CAN MAKING

TECHNICAL FIELD

The present invention relates to a method and an apparatus for making cans such as cans for storing and preserving food, cans for containing paint and the like. More specifically the invention relates to the production of cans, which are made from three pieces, namely a bottom part, a body part and a lid or closure and to cost efficient production of cans in small batch sizes.

BACKGROUND OF THE INVENTION

A large number of different methods and apparatuses for making cans are known. Cans are typically produced in large numbers by specially crafted tools and machines and thereby the production cost for each piece can be kept at a reasonable level. On the other hand, facilities for producing cans are custom made and adapted to produce one specific can size and can shape and the lacking flexibility results in relatively high costs for changing can type.

DESCRIPTION OF THE INVENTION

It is an object of the present invention to provide a method and an apparatus enabling fast and cost efficient shifts between cans of different sizes and shapes thus enabling smaller batch sizes in can production.

Accordingly the present invention provides a method of making a tubular can body from a blank of sheet material having a pair of opposite co-extending rim portions, method comprising gripping the rim portions by gripping means, mutually moving the gripping means so as to bring the rim portions into adjacent positions, and interconnecting the rim portions of the blank by a seam so as to form the tubular can body, while a major intermediate portion extending between the rim portions remains unsupported, at least internally.

The sheet blank is thus formed into a tubular can body without using any internal mandrel of a predefined shape. This method enables cans of different sizes to be made by use of the same tools without any reconfiguration of such tools. Only the gripping positions of the gripping means have to correspond to the size of the blank of sheet material.

Each of the gripping means may preferably be provided with at least two linear degrees of freedom and one rotational degrees of freedom. Thereby easy supply and discharge of respectively raw material and can bodies will be achieved. The gripping means should preferably be actuated by power driven means, controlled by a control system so as to enable forming of can bodies of different size. In one embodiment of the invention the gripping position can be set automatically by means of detectors determining the size of the blank of sheet material being processed.

The interconnecting seam can be made by interlocking engagement folded, hook-shaped rim portions, by seaming, welding, gluing, soldering or any other conventional seam making process. Preferably seam is made by interlocking pre-folded rim portions of the blank. The provided 3 degrees of freedom enables the the pre-folded rim portions to be interlocked while the folded parts are being pressed together.

According to a further aspect, the present invention provides a method of forming a tubular can body into a desired cross-sectional shape by means of a shape-defining device having a plurality of co-extending elongated contact surface parts for contacting the can body, said method comprising inserting the tubular can body in the shape-defining device such that the contact surface parts thereof each extends substantially axially in relation to the can body and adjacent to the inner or outer side surface thereof, and mutually moving the contact surface parts laterally into contact with the can body side surface or surfaces at peripherally spaced positions so as to peripherally extend the can body and impart the desired cross-sectional shape thereto. The tubular can bodies being formed into a desired cross-sectional shape may be formed by the method described above or by any known method. However, by using this shape-defining device it is less critical whether the cross-sectional shape of the tubular can body being formed has an accurate circular cross-section or any other cross-sectional shape. As mentioned above, this way of forming the can body into a predefined shape can be performed in connection with the above described method of making a tubular, cylindrical can body, or it can be performed in connection with can bodies made in any other way, such as by extrusion, moulding etc. The method enables different shapes to be imparted into the can body just by an exchange of simple tools and therefore a relatively small number of can bodies may be shaped rather cost efficiently.

The lateral movement of the contact surface parts may preferably be actuated by power driven means controlled by a controller in a way enabling a variable stroke length of the lateral movement. As an example the contact surface parts may be moved by pneumatically, hydraulically or electrically driven actuators controlled by a computer system. Cans of different size and/or shape may thus be formed without any physical changes to the shape-defining device.

According to another aspect of the invention, the tubular can body, or a sheet blank may be formed into a desired cross-sectional shape, by passing the blank or the tubular body wall through the nips of at least three pairs of co-operating, rotating shape defining rollers extending in the same general direction, and mutually transversely or rotationally moving said pairs of rollers so as to provide said desired cross-sectional shape. Each pair of rollers may be moved one by one or simultaneously and they may be moved either linearly or rotationally in relation to the path of the sheet or can body. The distance between the rollers in a pair of rollers may be varied so as to enable various sheet thickness or wall thickness of the can bodies. This way of forming a tubular can body into a desired cross-sectional shape may preferably be combined with the earlier described way of making a tubular can body from a blank of sheet material, thus providing a unified flexible means for forming cans from blanks of a sheet material.

Another aspect of the invention relates to a method of flanging, beading and curling a tubular body, such as a can body, or a sheet blank therefor. The sheet blank or the tubular body wall is passed into the nip of a pair of co-operating, rotating rollers having at a first end thereof flange forming means, which form a flange at an adjacent first end of the tubular body or blank and bead forming means being axially spaced from the flange forming means and forming a bead in an intermediate part of the blank or tubular body, and engaging a curling tool with an opposite, second end portion of the blank or body so as to curl said second end portion. In a preferred embodiment of the invention the flanging, beading and curling may be performed simultaneously with the forming of the sheet or can body according to the previous described way of forming a can body by use of rollers. The same pairs of rollers or at least the one pair of shape defining rollers may be used. The rollers must for this purpose be adapted for the flanging by means of a flanging edge at one end of at least one of the rollers. This could be an end portion of one of the co-operating rollers having an increased diameter and extending axially beyond the adjacent end of the other roller of said pair. The rollers must furthermore be adapted for beading by bead forming means such as an peripherally extending ridge formed on one of the co-operating rollers and a ridge receiving peripheral groove formed in the other of the co-operating rollers. A curling tool can preferably be movably positioned so as to enable engagement with an opposite end of the blank or body in relation to the end where the flange is made.

The seam of the tubular can body may be made in any conventional manner. As an example, the rim portions of the can body blank may be pre-formed so as to define seam parts, which are interlocked and subsequently flattened so as to form said seam. This procedure enables a simple and cheap tool for making the seam. Alternatively, the seaming tool may bend both rim portions, provide the interlocking engagement, and subsequently flatten the bent rim portions so as to stabilise the interlocking engagement. Standard tools for these procedures are generally available on the market.

A tubular can body may be seamless, for example when it has been made by extrusion. Usually, however, the can body has a longitudinally extending seam. When such can body is to be formed into a desired cross-sectional shape by the method described above the longitudinally extending seam is preferably gripped between one of said contact surface parts and an oppositely arranged backing member. Thereby it may be avoided that the peripheral stresses, which are generated in the can body wall by the shape-defining device, are transferred to the seam so as to cause defects or leakage thereof.

The desired cross-sectional shape of the tubular can body may be obtained by arranging all of the contact surface parts within the can body and by moving at least one of them radially outwardly, or by arranging at least two and preferably at least three contact surface parts within the tubular can body and one or more radially outside the can body and by moving at least one inner contact surface part radially outwardly and/or at least one outer contact surface part radially inwardly so as to bring all of the contact surface parts into contact with the can body and define the desired cross-sectional shape and so as to provide the necessary peripheral stress in the can body wall to obtain the desired permanent shape. This means that all of the contact surface parts may be moved transversely or radially in relation to the can body, or one or more of the contact surface parts may be maintained substantially stationary in relation to the can body during said mutual lateral movement of the contact surface parts.

As mentioned above, all of said elongated contact surface parts can be located within the inner space of the tubular can body, and at least one of the contact surface parts may then be moved transversely in relation to the other contact surface parts, so as to bring all of said contact surface parts into abutting engagement with the inner side surface of the can body. Alternatively, however, a first number of said elongated contact surface parts may be located in the inner space of the tubular can body and a second number of said elongated contact surface parts may be located outside the tubular can body, at least one of said first number of contact surface parts being moved laterally outwardly into contact with the inner side surface of the can body, and/or at least one of said second number of contact surface parts is moved laterally inwardly into contact with the outer side surface of the can body, so as to bring all of said contact surface parts into abutting engagement with the inner or outer side surface of the can body. In this way the shape of the can body can be imparted both from the outside of the can body and from the inside of the can body or from both sides in combination. This means that seen from the outside the shaped can body may have convex parts only or a combination of convex and concave surface parts.

The elongated contact surface parts may comprise a plurality of rod members having a circular or polygonal cross-sectional shape. Each such rod members may contact the can body along a longitudinal extending, narrow contact area only so as to form a plain inner or outer sharp or rounded corner part on the can body. It may be desired to form corner parts or other wall parts of the can body having a more sophisticated cross-sectional shape. Thus, each of the contact surface parts may have a cross-sectional shape, which is substantially complementary to the desired cross-sectional shape of can body wall parts at respective, peripherally spaced positions of the can body. As an example, apart from sharp edged, rounded or otherwise shaped corner portions the contact surface parts may be used for forming decorative embossments in the side walls of the can body.

As indicated above, the contact surface parts are preferably defined on a plurality of elongated, substantially co-extending rod-like members. In a preferred embodiment the rod-like members are sleeve-like members of which at least some are removable mounted on a core, such as a rod or shaft. This allows for fast and easy exchange of contact surface parts, e.g. for changing the desired cross-sectional shape or for replacement of worn or otherwise defect surface parts. The sleeve-like members can be made from any suitable material, such as from metal or another hard or hardened material, or they can be made from a resilient material, such as a resilient rubber or rubber-like material depending upon the materials characteristics of the sheet material from which the can body has been made.

The can bodies may be made from any suitable material, including plastics material. However the can bodies are preferably made from a conventional sheet metal, such as tinplate, aluminium or aluminium alloys.

According to a further aspect, the present invention relates to a method for fastening a bottom part to a can body, said method comprising positioning the bottom part at one end of the can body such that a rim portion of the bottom part is in abutting engagement with a radial flange formed at said one end, rotating the can body in relation to at least one seaming such as curling, bending or folding tool, and moving said seaming tool radially in relation to the can body along a predetermined path corresponding to the cross sectional shape of the can body. The seaming tool may be moved radially in relation to the can body by any suitable moving means. As an example, the seaming tool may be movable by means of an actuator, which is controlled by a computer. The computer may control the actuator in accordance with a program loaded into its memory. Thus the actuator may be controlled to move the tool radially in relation to the can body so as to follow the pre-determined path corresponding to the cross sectional shape of the can body. In this way cans of different size and with quite different cross-sectional shapes may be produced by means of the same device, provided that the relevant program or pre-determined path be loaded into the memory of the computer. The pre-determined path may be loaded from a computer aided design tool or from a similar CAD/CAM related tool.

Alternatively, the means for radially moving the seaming tool may comprise means for biasing the seaming tool into engagement with said rim portion and/or with said radial flange at a predetermined substantially uniform biasing force during said relative rotation of the can body and the tool, so as to bend or fold said rim portion and/or said flange. This is preferably done by means of force-controlled actuators. Contrary to traditional ways of interconnecting bottom parts with can body parts, where a predetermined path is followed, the advantage of using force controlled actuators is that such actuators follow the specific shape of a given can body and bottom assembly line and thus compensate for tolerances.

In a preferred embodiment of the invention the can bottom is being fastened to the can body by means of a plurality of peripherally spaced seaming tools, moved or biased into engagement with said rim portion and/or with said radial flange. Each of the tools being adapted to perform different bending or folding operations so as to form a seam.

As a further possibility, each of one or more of the tools for seaming such as curling, bending or folding operations may be moved along a radial guide member and biased into engagement by spring means or by means of a linear electric motor. These solutions offer a cheap and reliable fastening operation and flexibility and high performance in the fastening operation, respectively.

In a preferred embodiment of the invention the method for fastening the can bottom part to the can body part includes a controlled interdependency between the radial movement of the tool in relation to the rotation of the can body and the shape of the can body. This enable fastening of a can bottom part to a can body part having non-circular cross-sectional shape such as a square or triangular shape. When the tool passes a corner or sharp edge the rotational speed of the can body is decreased in order to allow the tool to change its direction.

According to another aspect the present invention relates to an apparatus for can making according to the previously mentioned method.

BRIEF DESCRIPTION OF THE DRAWINGS

The invention will now be further described more in detail with reference to the drawings, in which.

DESCRIPTION OF PREFERRED EMBODIMENTS

Figure 1:
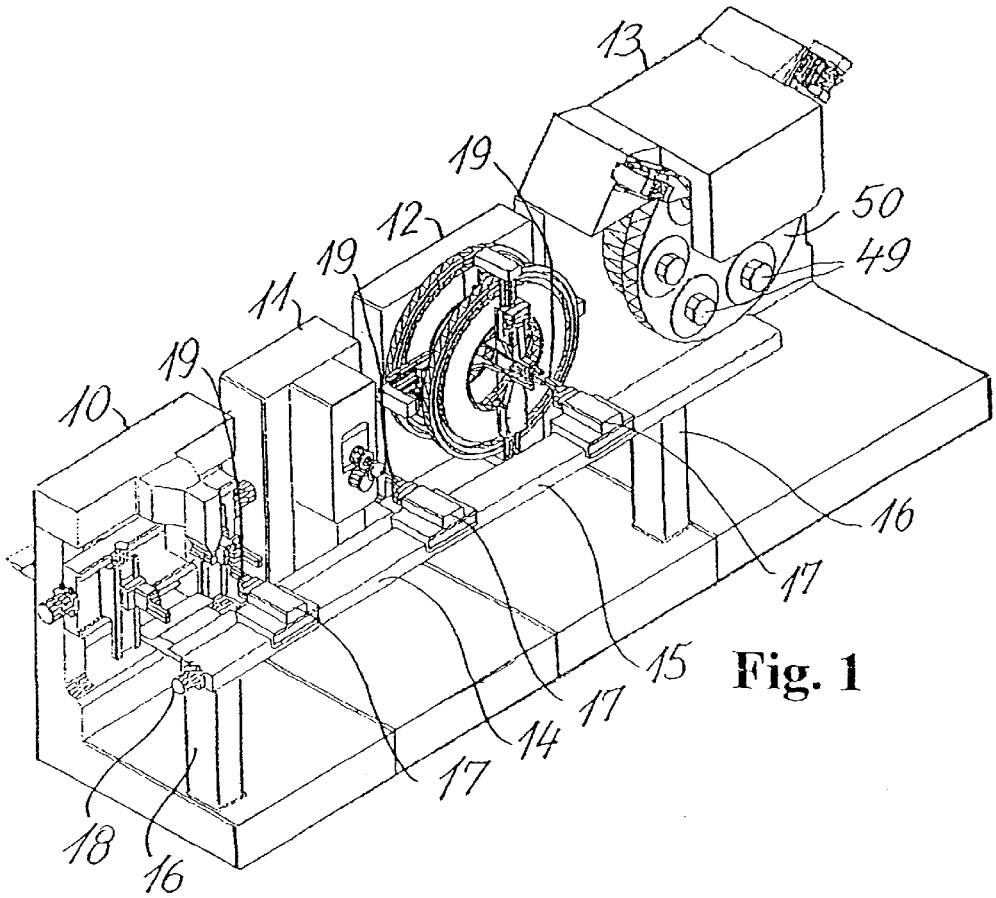
FIG. 1 is a perspective view of a can production line embodying the present invention.

FIG. 1 shows a production line for making cans. This production line comprises a number of apparatuses for performing certain functions arranged in line, namely an apparatus 10 for making can bodies, an apparatus 11 for curling, flanging and beading an upper and lower rim portion and an intermediate portion of the can bodies, an apparatus 12 for forming the can bodies into a desired cross-sectional shape, and an apparatus 13 for connecting a bottom part to the bottom rim portion of each of the can bodies by a seaming operation. The apparatuses 10–13 are oriented such that a can body being processed has its central axis extending substantially horizontally. In another embodiment of the invention they could be oriented such that a can body being processed has its central axis extending substantially vertically.

Can bodies made by the apparatus 10 are successively transported or transferred to the other working stations represented by the apparatuses 11–13 by means of a transfer device 14. This transfer device 14 comprises a guide bar 15 extending substantially horizontally along the front surfaces of the apparatuses 10–13. The guide bar 15 is supported by a pair of posts 16. Carriages 17 are arranged slideably along the guide bar 15, and each carriage may be moved reciprocatingly between a pair of adjacent apparatuses 10–13 by means of an electric motor 18 via suitable transmission means, not shown. Each carriage 17 has a pair of movable fingers 19 for gripping an adjacent rim part of a can body to be transferred.

Figure 2:
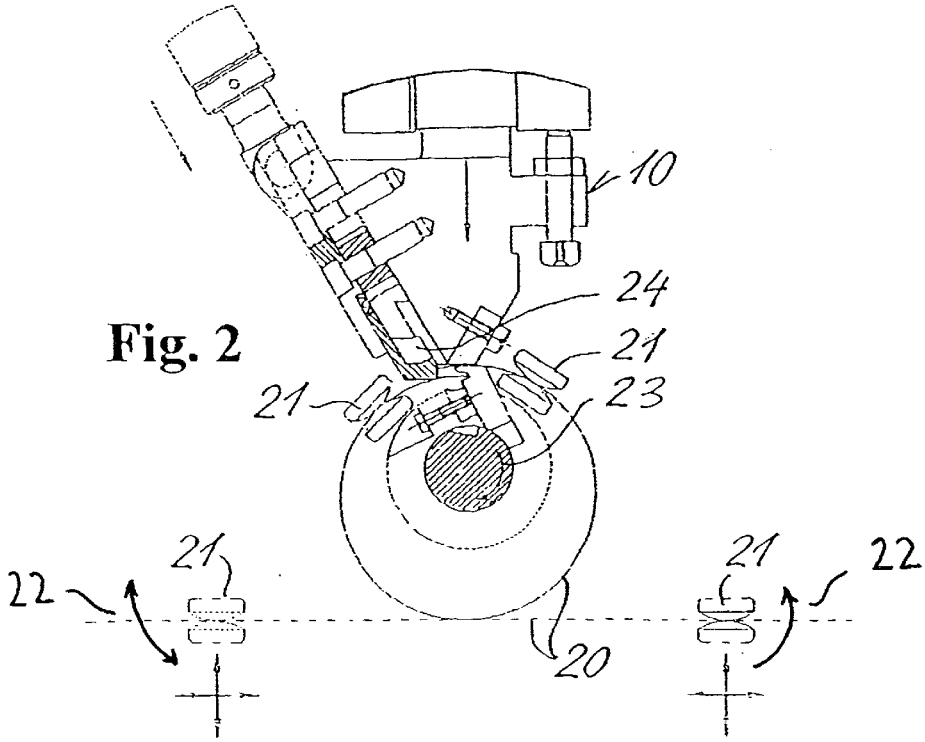
FIG. 2 is a diagrammatic front view of an apparatus for making can bodies and shown in FIG. 1, FIGS. 3 and 4 are fragmentary cross-sectional views of a seam-making device of the apparatus shown in FIG. 2.
Figure 3:
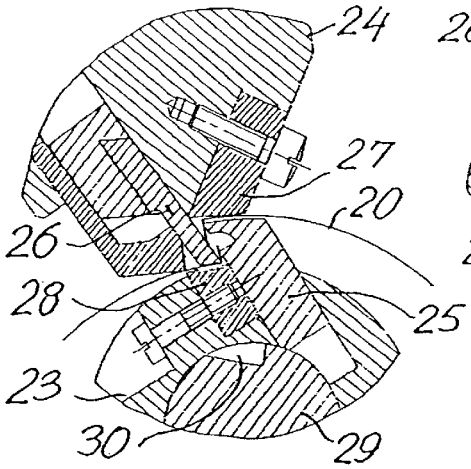
Figure 4:
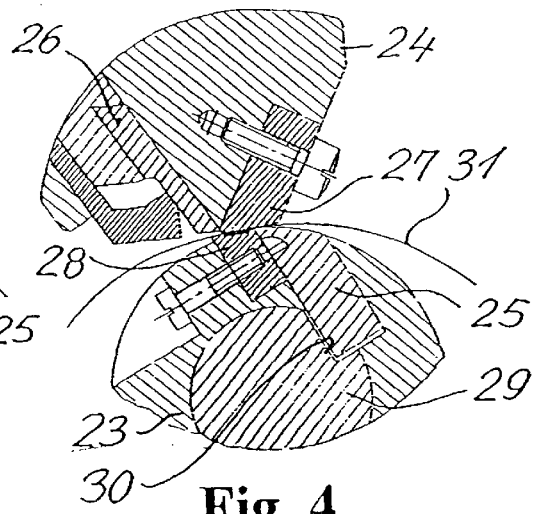

As best illustrated in FIGS. 2–4, the can body making apparatus 10 may bend a rectangular blank 20 of sheet metal into tubular form and then interconnect adjacent edge portions of the blank by forming them into a seam. Blanks 20 of a suitable sheet material, such as tin plate, aluminium or an aluminium alloy, is passed into a position shown in dotted lines in FIG. 2. An operator may manually take a blank 20 at the time from a stock and place it in gripping devices 21 or the blank may automatically be transported from the stock by transporting means (not shown). Such transporting means may include means for advancing an end portion of a stock coil of sheet material and means for cutting a blank from such end portion.

The gripping devices 21 are now moved either upwardly or downwardly and towards each other as indicated by arrows 22 so as to position opposite edge portions of the blank 20 in adjacent mutually overlapping positions between an internal device 23 and an external device 24 of a seam maker, which forms part of the can body making apparatus 10. The griping devices is preferably of a type which may grip the edge portions of the blank 20 securely without leaving any marks on the surface of the blank. By the said upward or downward movement of the gripping devices 21 the blank is formed into a tubular member while the blank intermediate of the gripped edge portions remains unsupported internally as well as externally. The gripping devices 21 may, for example, be moved by means of one or more electrically, hydraulically or pneumatically driven motors and may, for example be guided along a cam surface. Alternatively, the gripping devices may be moved by a multiple linkage mechanism to follow a predetermined, but changeable path so as to bring the edge portions of the blank into the mutual position between the internal and external devices 23 and 24, respectively of the seam maker.

Reference is now made to FIGS. 3 and 4. When the adjacent edge portions of the blank 20 have been positioned between the internal and external devices 23 and 24 of the seam maker a slide member 25 of the internal device 23 and a slide member 26 of the external device 24 are moved towards each other so as to clamp the blank edge portions between said slide members and respective stationary abutment members 27 and 28, respectively, and at the same time form a folded edge part or hook part on each of the overlapping edge portions of the tubular blank 20, vide FIG. 3. A central, rotatable core member 29 of the internal device 23 has a recess 30 formed in its outer cylindrical surface. Now, the core member 29 is rotated into a position in which the recess 30 is aligned with the slide member 25 of the inner device 23, and the inner and outer devices 23 and 24 are moved toward each other. Thereby the hook parts formed on the opposite edge portions of the blank 20 are moved into mutual engagement and subsequently flattened and interlocked into a seam so as to form a can body 31 as illustrated in FIG. 4. Alternatively the rim portions of the blank could pre-formed so as to form seam parts which are then interlocked and subsequently flattened. For the process of interlocking and flattening pre-folded seam parts of the rim portions of the blank, it will be required to provide the gripping devices with at least two linear degrees of freedom and one rotational degree of freedom, as described above and as illustrated in FIG. 2, see numeral 21 and 22.

It should be understood that the devices 23 and 24 forming the seam maker of the apparatus 10 may be replaced by any other conventional or non-conventional type of seam maker, including devices for making seams by seaming, welding, gluing, soldering and/or mechanical interlocking.

The same can body maker 10 may be used for making a large variety of can bodies without any complicated or time consuming changes of tools. Thus, after having been used for producing small can bodies 31 the can body maker 10 may, for example be made ready for producing large can bodies only by varying the position of the gripping devices 21 such that the blanks 20 of sheet material are gripped at substantially the same distances from the opposite edges of the blank. This allows for cheap and uncomplicated shifts between production of can bodies of various sizes.

Figure 12:
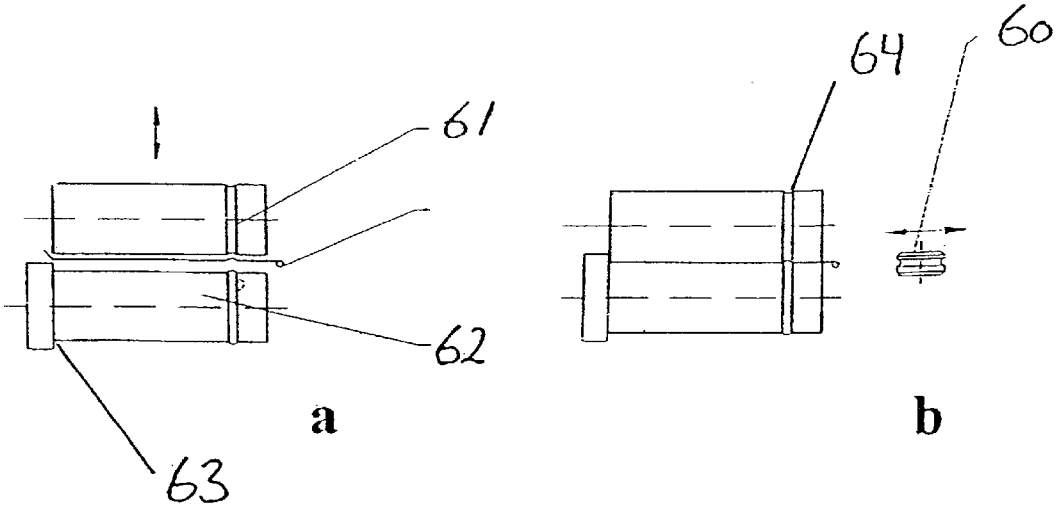
FIG. 12 is a fragmentary view of the device shown in FIG. 11 as seen from the side.

When a can body 31 has been formed by the apparatus 10 as described above, it is transferred to the next working station, namely the flanging, beading and curling apparatus 11, FIG. 1, by means of the transfer device 14. In the apparatus 11 the top rim part of the can body is curled in a conventional manner so as strengthen such rim portion and make it ready to receive a lid therein in a conventional manner. Alternatively the top rim portion is flanged in order to make it ready to receive a fixed closure like the bottom part. In the apparatus 11 the bottom rim part of the can body is flanged to prepare the fitting of a can bottom part. Alternatively the bottom rim part may be curled like the top rim part in order to make the can body ready to receive a lid both at the top and the bottom rim part or if the can body is to be used without a bottom or lid part. The apparatus 11 may also form a circumferentially extending corrugation or elevation mark in the upper part of the can body wall. Such beading may further strengthen the can body wall and serve as a stop or seat for the lid of the can. The tree processes, flanging, beading and curling may either be performed subsequently or simultaneously. An apparatus for flanging, beading and curling a can body or a sheet blank simultaneously is shown in FIG. 12. The apparatus has a pair of co-operating, rotating rollers 61, 62 forming a nip there between. At one end of the rollers a flange-forming tool 63 is provided for bending one end of the sheet blank or tubular body wall into a flange. This tool could be formed by an end portion of one of the co-operating rollers 62 having an increased diameter and extending axially beyond the adjacent end of the other roller 61. A bead forming tool 61 is provided in an intermediate part of the rollers. This tool can be formed by a peripherally extending ridge formed on one of the rollers 62 and a receiving peripheral groove formed in the other of the rollers 61. A curling tool 60 is movably mounted for engagement with an opposite portion of the blank in relation to the flange.

The can body with the flanged or curled bottom end, the bead and/or curled or flanged top end may now be transferred from the flanging, beading and curling apparatus 11 to the apparatus 12 by means of the transfer device 14. As an alternative the can body may be flanged, beaded and curled in three successive operations with intermediate transfer of the can body.

Figure 5:
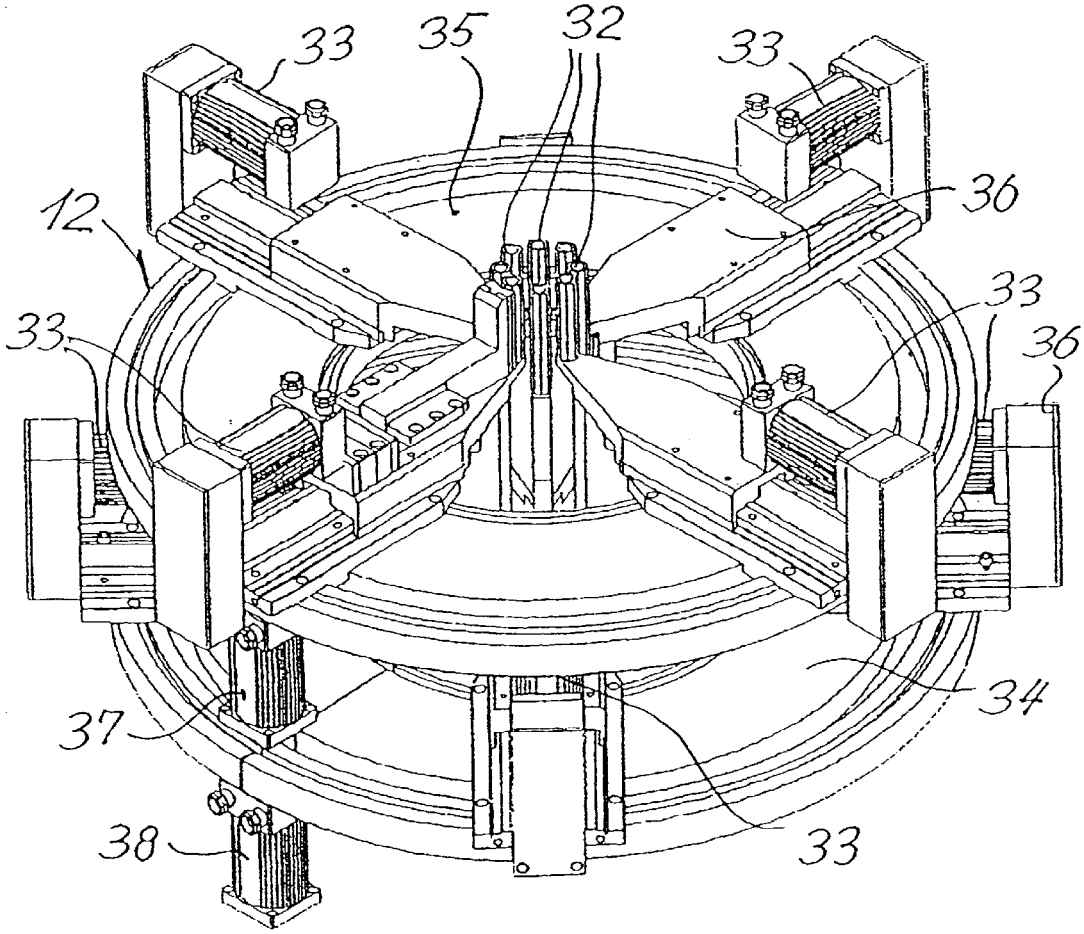
FIG. 5 is a front perspective view of an apparatus, which is shown in FIG. 1, for forming can bodies into a desired cross-sectional shape.

The apparatus 12 (FIG. 5), which is adapted to form the can body into a desired cross-sectional shape, comprises a plurality of substantially parallel rod members 32, which extend substantially horizontally in FIG. 1. However the rod members may also extend vertically. At least some of the rod members 32 are movable transversely, and in the embodiment shown in FIG. 5 each of the rod members 32 has an actuator 33, such as an electric motor or a hydraulic or pneumatic cylinder, associated therewith. The stroke length of the electric motor or hydraulic or pneumatic cylinder may preferably be adjustable so that the transverse movement of the rod members can be adjusted between each activation of the apparatus without having to rebuild the apparatus. Thereby a flexible means of adjusting the apparatus according to a specific desired shape and/or size of a can is thereby achieved. The actuators 33 with their rod members 32 are arranged on two axially spaced platforms, an inner platform 34 and an outer platform 35. In the embodiment shown in FIG. 5 four rod members with four associated actuators 33 form a cross-like unit 36, which is rotatably mounted on each of the stationary platforms 34 and 35. Each of the cross-shaped units 36 may be rotated in relation to the associated platform about a central axis by means of electric motors 37 and 38 or other moving means. As shown in FIG. 5, the free ends of all of the rod members 32 extend outwardly from the unit 36 of the outer platform 35. The shape imparted by the rod members can be easily changed just by rotating the rod members so that another area of the contact surface will engage the can body. One rod member could as an example have a contact surface composed of two, three, four or even five different predetermined shapes for imparting respective shapes into the can body relative to the rotational position of the rod member.

A can body 31 which is positioned around the free ends of the rod members 32 may be given any polygonal cross-sectional shape with up to eight angles. This may be done by moving the relevant number of the rod members 32 in the relevant angular positions radially outwardly into contact with the inner side of the tubular can body 31 by means of the associated actuators 33 and by applying the necessary force to the rod members so as to permanently form the can body into the desired cross-sectional shape. It should be understood, however, that any number rod members with associated actuators and any practical number of axially spaced platforms could be used. Each of the rod members and the associated actuator on such platform could in itself form a unit and such units could be mutually rotationally adjustable in relation to the associated platform. The units could be adjusted manually or by mechanical means.

The rod members 32 need not all be arranged inside the can body 31 and be moved radially outwardly into contact with the inner side of the can body as described above in connection with FIG. 5. Alternatively, some of the rod members 32 may be positioned outside the can body and be moved radially inwardly into contact with the outer wall of the can body so as to form concave outer surface parts thereon.

Preferably the seam of the can body is supported during the forming of the cross-sectional shape. This is of particular importance if the seam is provided by mechanical interlocking of folded rim portions such as a seaming.

Figure 6:
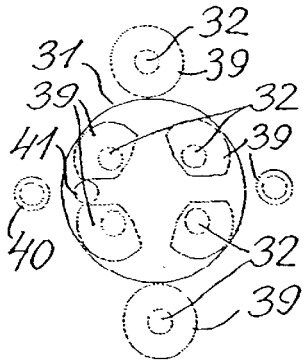
FIGS. 6–8 are diagrammatic cross-sectional views illustrating the function of the apparatus shown in FIG. 5.
Figure 7:
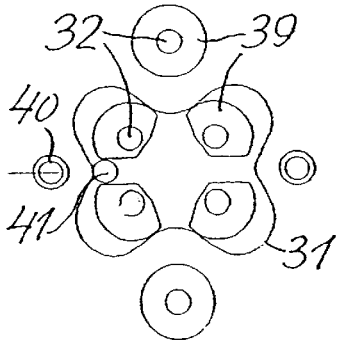
Figure 8:
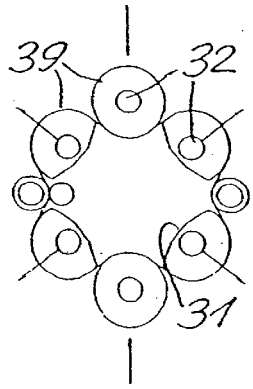

FIGS. 6 and 7 illustrate how a can body 31 having a substantially circular cross-section can be formed into a cross-sectional shape comprising convex as well as concave surface parts. Furthermore, as illustrated in FIGS. 6–8, at least some of the rod members 32 may be provided with an interchangeable outer sleeve member 39 having a contact surface part being complementary to the desired shape of the can body part being contacted thereby. When the can body 31 has a seam, such seam is preferably pinched between an outer and an inner rod member or sleeve member 40 and 41, respectively, while the can body is being formed into the desired cross-sectional shape and, consequently, peripherally stretched.

FIG. 6 shows a can body 31 with a circular cross-section inserted in the apparatus 12 such that four rod members 32 provided with sleeve members 39 are arranged inside the can body and four such rod members with sleeve members are positioned outside the can body and rotationally displaced in relation to the inner members. Furthermore, an inner member 41 is provided for co-operating with one 40 of the outer members for pinching the can body seam there between as explained above. FIG. 8 illustrates the formation of an alternative cross-sectional shape, which may be obtained by using the apparatus 12 shown in FIG. 5. FIG. 7 illustrates the same as FIG. 8 after completion of the forming operation.

The apparatus 12 shown in FIG. 5 may further comprise means for exchanging the sleeve members 39 when can bodies with another cross-sectional shape is to be produced. This feature further facilitates a shift between production of cans having different cross-sectional shapes and potentially reduces the cost efficient batch sizes of the can production. The various sleeve members 39 may be stored in a "library" and reused in different combinations.

Figure 11:
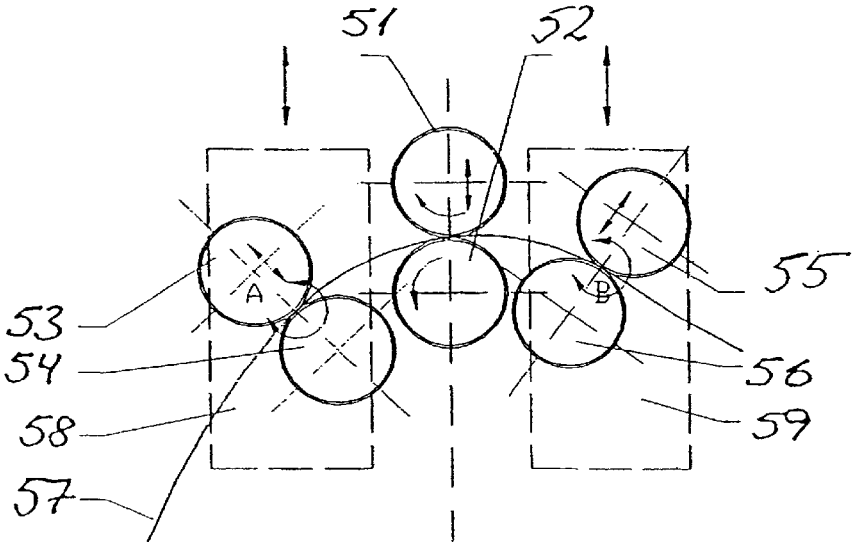
FIG. 11 is a fragmentary cross-sectional view of a flanging, beading, curling and shape defining device.

Another apparatus for forming a tubular can body or a sheet blank therefor is shown in FIG. 11. According to this embodiment of the invention a desired cross-sectional shape is formed by three pairs of rotating rollers 53–54, 51–52 and 55–56 extending in the same general direction. While the sheet blank or can body 57 is inserted into the nips of the co-operating rollers at least one of which is conveying the sheet blank or can body by rotation, the sheet is being formed by means of mutually transversely and rotationally moving the pairs of rollers. In a preferred embodiment of the invention an image of the desired cross-sectional shape is stored in a computer and the pairs of rollers are then moved by a set of actuators controlled by the computer. In one preferred embodiment the one pair of rollers are fixed 51–52 and the other two pairs of rollers 53–54 and 55–56 are moved by actuators 58 and 59.

In a preferred embodiment of the invention the pair of rollers for flanging, beading and curling e.g. as seen in FIG. 12 is included in the apparatus shown in FIG. 11 for forming the cross-sectional shape of the sheet blank or can body. In this embodiment either one of the pairs of rollers such as 51–52 or all of the pairs of rollers 51–56 can be formed like the rollers 61,62. A curling tool is movably mounted for engagement with an opposite portion of the blank in relation to the flange as seen in FIG. 12*b*.

It must be understood that the apparatus shown in FIG. 11 can be comprised in the production line shown in FIG. 1. In this case the apparatus can replace the apparatuses 11 and 12 for respectively flanging, beading, curling and forming the cross-sectional shape.

Figure 13:
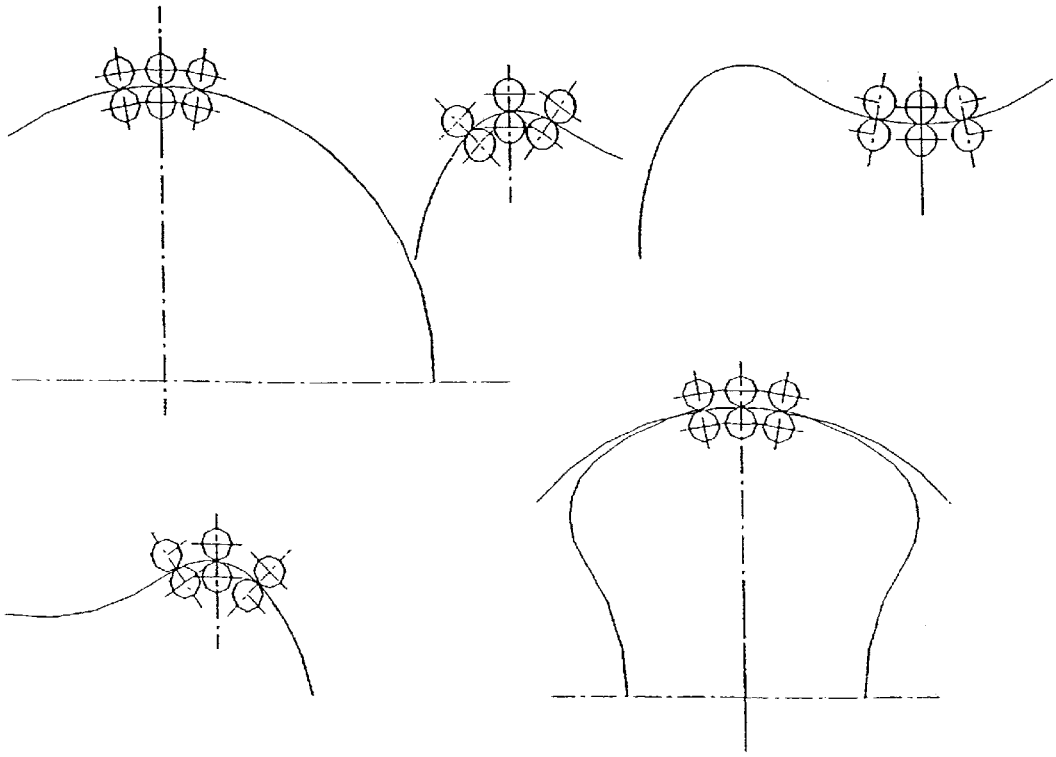
FIG. 13 is a diagrammatic cross-sectional view of the shape defining process of the device shown in FIGS. 11–12.

One advantage of the apparatus shown in FIG. 11 is the ability of forming curves with inwardly as well as outwardly extending radius—positive and negative radius. This is shown in FIG. 13.

When a can body 31 has been given a desired cross-sectional shape in the apparatus 12 it is transferred to the apparatus 13 (FIG. 1) for fastening a bottom part thereto. The can body is transferred from the apparatus 12 to the apparatus 13 by means of a carriage of the transfer device 14.

Figure 9:
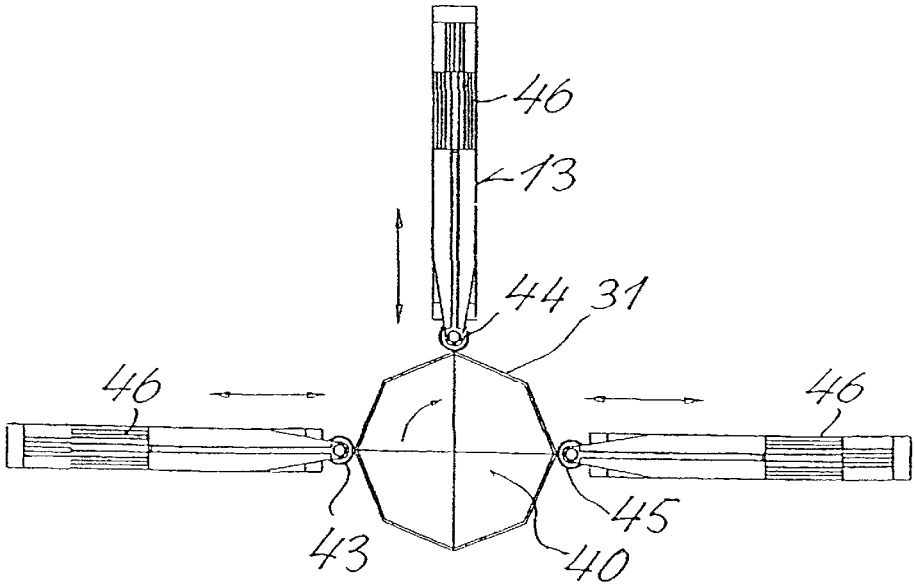
FIG. 9 is a diagrammatic front view illustrating the seaming operation of an apparatus, which is shown in FIG. 1, for connecting a bottom part to each of the can bodies made by the apparatuses shown in FIGS. 2–4 and in FIGS. 5–8, respectively.
Figure 10:
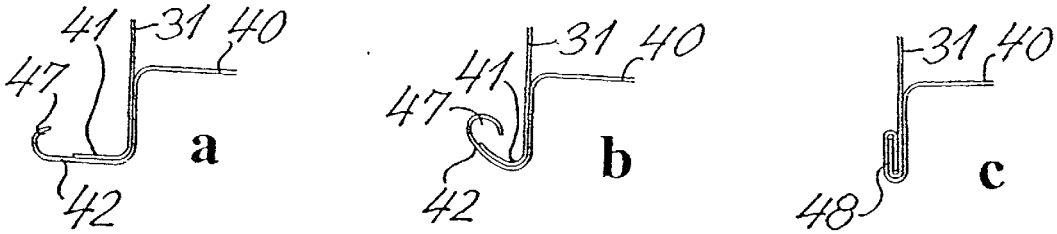
FIG. 10 illustrates the seaming steps performed by the apparatus shown in FIG. 9.

The function of the apparatus 13 is best illustrated in FIGS. 9 and 10. FIG. 9 is a diagrammatic front view of the apparatus 13 as illustrated in FIG. 1 and a bottom view of a can body 31 to which a prefabricated can bottom part 40 has been applied. The can body 31 may have a radially outwardly extending flange 41, which may, for example have been formed by the flanging, beading and curling apparatus 11 of the production line shown in FIG. 1. The bottom part 40 has a similar flange 42 which is positioned in abutting engagement with the flange 41 of the can body 31.

As shown in FIG. 9, the apparatus 13 has seaming tools 43, 44 and 45, respectively for folding the two flanges into interlocking engagement. Each of the tools 43, 44 and 45 radially movable and is biased towards the flanges 41, 42 by means of an actuator 46, such as a spring mechanism, an electric linear motor or another electrically actuated device. While the can body 31 with the bottom part arranged thereon is rotated, the seaming tool 43 is moved radially into contact flange 42 of the bottom part thereon so as to form a curl 47 thereon as illustrated in FIG. 10*a*. Subsequently, the seaming tool 44 is bending or folding the mutually abutting flanges 41 and 42 into the shape illustrated in FIG. 10*b*, and, finally, the seaming tool 45 is moved biased towards the folded flanges 41, 42 shown in FIG. 10*b* so as to form a seam 48 as illustrated in FIG. 10*c*.

During operation, the tools 43–45 are preferably moved radially in relation to the can such that a substantially constant pressure is applied to the seam being made. The radial motion of the tools is either predetermined based on the known cross-sectional shape of the can body or it is determined by the actual pressure between the flanges 41 and 42 and the tools 43–45. When the tools are moved radially based on the predetermined cross-sectional shape of the can body, such shape is preferably transferred as a computer file from a computer aided design tool or a computer aided manufacturing tool to a computerised controller of the apparatus 13. In case of moving the tools so as to obtain a constant pressure on the seam, the tools are preferably moved by a force controlled actuator or by a similar force controlled device. The sensing and/or force control loupe of such a device could either be an integrated part of a computerised control of the device for fastening the can bottom part to the can body, or it could be a separate control circuit of the actuator device.

As shown in FIG. 1, the apparatus 13 may comprise a plurality of mandrels 49 positioned in an annular arrangement on a stepwise revolving plate 50. Thus, a can body 31 with a bottom part 40 to be fixed thereto is positioned on one of the mandrels 49 and the plate 50 is then stepwise rotated to positions in which the can body and the bottom part successively is worked by the curling tool 43, the folding tool 44 and the beading tool 45, respectively. The completed can is removed from the mandrel 49 and transported to a storage site.

The radial motion of the tools in relation to the peripheral position of the can body may be monitored and stored in a file. These data may be used for the purpose of quality control.

Figure 14:
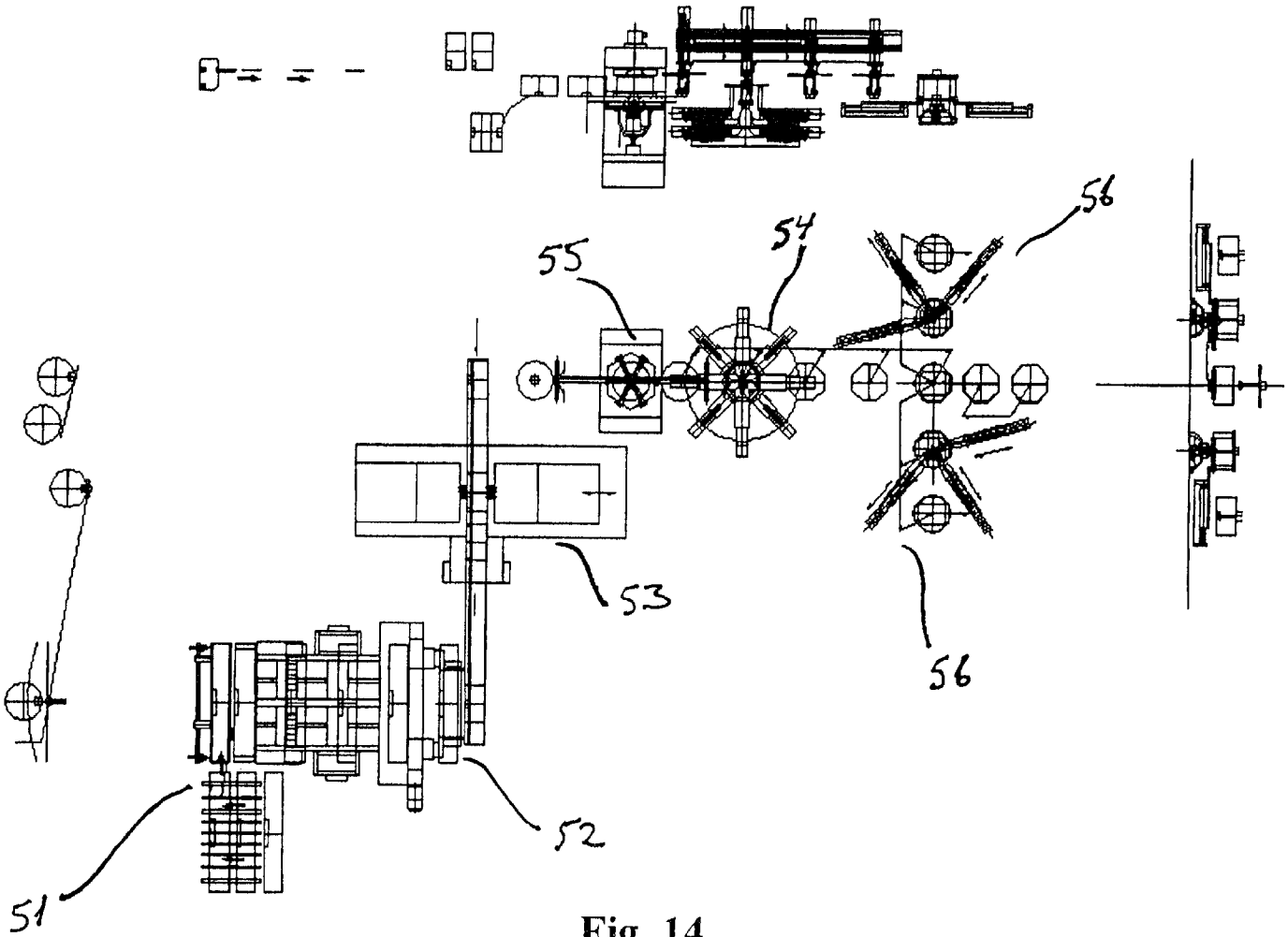
FIG. 14 shows the layout of a production plant according to the present invention.

Referring to FIG. 14, the various apparatuses may be combined in to a can producing facility. In FIG. 14 the sheets of metal are being cut into size at the raw material handling station 51. The tubular can bodies are being made at the body maker 52. At the station 53, the can bodies are flanged and beaded. At the orientation station 55, the can bodies are rotated into a certain position of the seam thus being ready for the forming process taking place in the expander 54. Two bottom assembly apparatuses 56 are provided in order to level out the capacity, since the process of assembling the can body and bottom is more time consuming than the processes of making the can body.

Figure 15:
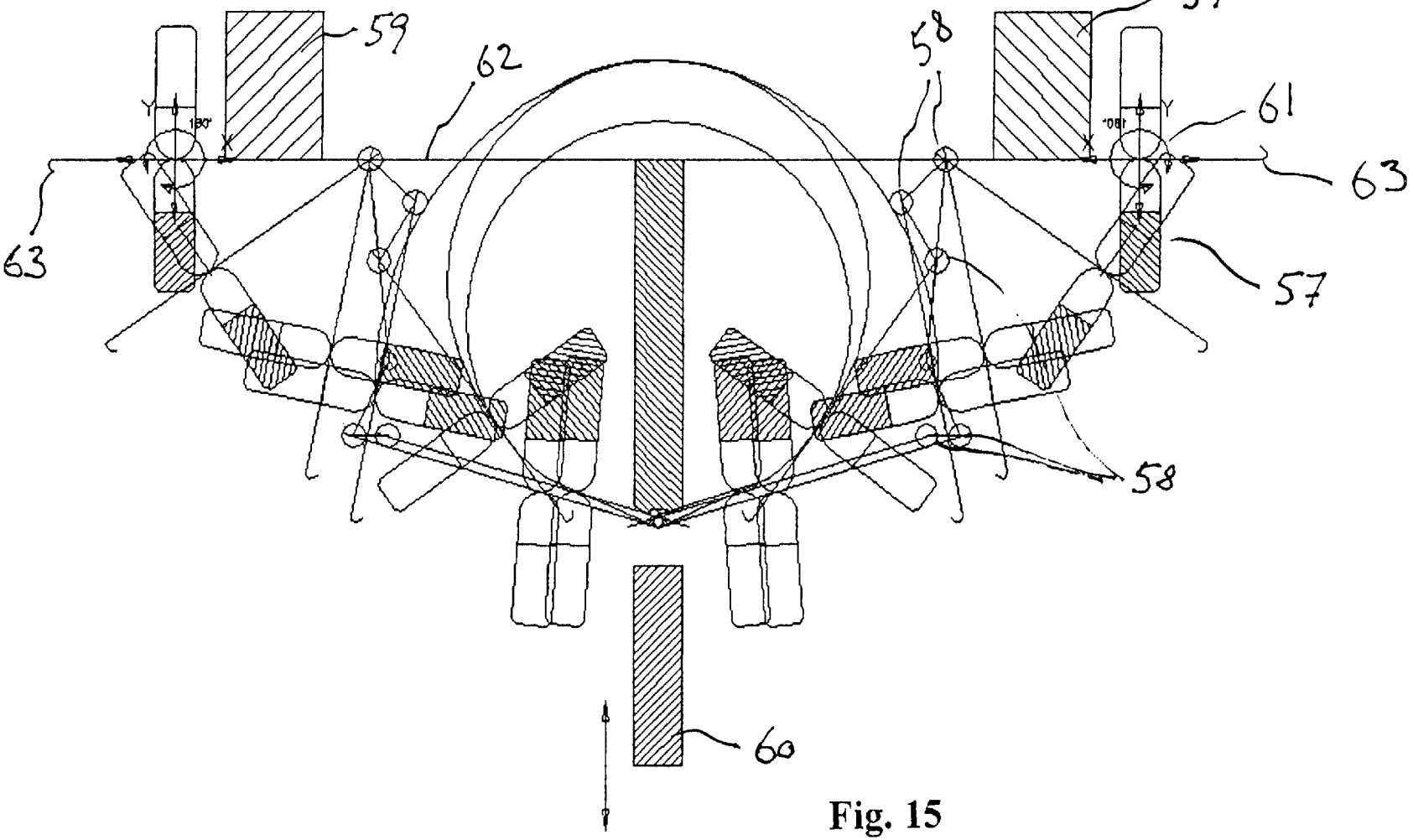
FIG. 15 shows a diagrammatic view of the making of the tubular body according to the invention.

FIG. 15 shows a diagrammatic view of the making of the tubular body according to the invention. As indicated in FIG. 15, the gripping device 57 may be moved linearly in two directions and rotated around an axis see the indication of degrees of freedom 61. The circles 58 indicate centre points for rotation of the gripping means. The blank of sheet metal 62 is held by the magnets 59 until they are grabbed by the gripping means 57. As indicated the blanks of sheet metal may have pre-folded rim portions 63. The gripping means are moved and rotated so as to bring the pre-folded rim portions into engagement before they are pressed firmly by the press tool 60 for locking the engagement.

Figure 16:
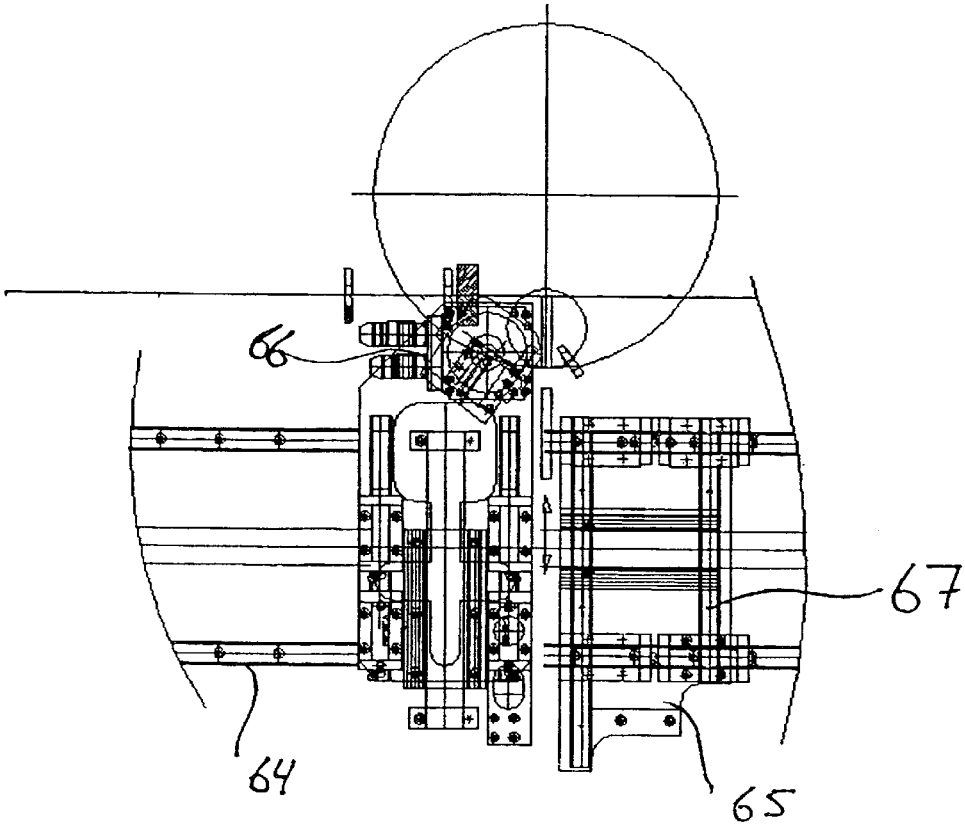
FIG. 16 shows a front view of a body maker according to the invention.

FIG. 16 shows a front view of a body maker according to the invention. The means for linearly moving and rotating the gripping means comprises a linear track 64 for linear movement of the sledge 65 in one direction and a linear track 67 for linear movement of the sledge 65 in a perpendicular direction. The sledge is provided with a servomotor for movement of the sledge in each of the two directions. The servo motor 66 is adapted for rotation of the gripping means. The servomotors are being connected to a control system for controlling the position and rotation of the gripping means. When changing from the production of cans in one size to the production of cans in another size, the controller must be reprogrammed for moving the gripping means according to the size of the can being produced. No mechanical re-configuration of the device is needed.

Figure 17:
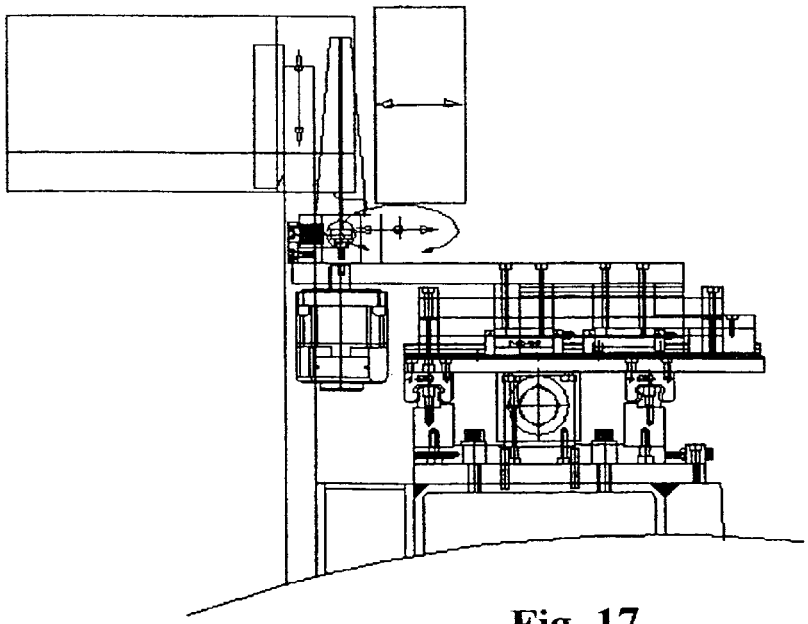
FIG. 17 shows a side view of the body maker shown in FIG. 16.

FIG. 17 shows a side view of the body maker shown in FIG. 16.

It should be understood that various changes and modifications of the embodiments described above with reference to the drawings may be made within the scope of the present invention. As an example, the various apparatuses forming the product line shown in FIG. 1 need not be used in combination, but may be used separately or in combination with any other apparatuses.

What is claimed is:

1. A method of making a tubular can body from a blank of sheet material having a pair of opposite co-extending rim portions, said method comprising gripping the rim portions by gripping means being actuated by power driven means controlled by a controller in a way enabling re-defining the movement without mechanical reconfiguration, mutually moving the gripping means so as to bring the rim portions into adjacent positions, and interconnecting the rim portions of the blank by a seam so as to form the tubular can body, while a major intermediate portion extending between the rim portions remains unsupported, at least internally.

2. A method according to claims 1, wherein the rim portions of the can body blank are pre-formed so as to define seam parts, which are interlocked and subsequently flattened so as to form said seam.

3. A method according to claim 1, wherein the tubular can body is formed into a desired cross-sectional shape by means of a shape-defining device having a plurality of co-extending elongated contact surface parts for contacting the can body, said method comprising inserting the tubular can body in the shape-defining device such that the contact surface parts thereof each extends substantially axially in relation to the can body and adjacent to the inner or outer side surface thereof, and mutually moving the contact surface parts laterally into contact with the can body side surface or surfaces at peripherally spaced positions so as to peripherally extend the can body and impart the desired cross-sectional shape thereto.

4. A method according to claim 3, wherein the lateral movement of the contact surface parts is actuated by power driven means controlled by a controller in a way enabling a variable stroke length of the lateral movement.

5. A method according to claim 1, wherein the can body has a longitudinally extending seam, said seam being gripped between one of said contact surface parts and an oppositely arranged backing member while the can body is extended peripherally.

6. A method according to claim 1, wherein one or more of the contact surface parts is/are maintained substantially stationary in relation to the can body during said mutual lateral movement of the contact surface parts.

7. A method according to claim 1, wherein all of said elongated contact surface parts are located within the inner space of the tubular can body, at least one of the contact surface parts being moved transversely in relation to the other contact surface parts, so as to bring all of said contact surface parts into abutting engagement with the inner side surface of the can body.

8. A method according to claim 1, wherein a first number of said elongated contact surface parts is located in the inner space of the tubular can body and a second number of said elongated contact surface parts is located outside the tubular can body, at least one of said first number of contact surface parts being moved laterally outwardly into contact with the inner side surface of the can body, and/or at least one of said second number of contact surface parts being moved laterally inwardly into contact with the outer side surface of the can body, so as to bring all of said contact surface parts into abutting engagement with the inner or outer side surface of the can body.

9. A method according to claim 1, wherein each of the contact surface parts has a cross-sectional shape being substantially complementary to the desired cross-sectional shape of the respective one of said peripherally spaced positions of the can body.

10. A method according to claim 1, wherein said contact surface parts are defined on a plurality of elongated, substantially co-extending rod-like members.

11. A method according to claim 10, wherein the contact surface parts are defined by outer sleeve-like members each being removable mounted on a rod or shaft.

12. A method according to claim 1, wherein the can body is made from sheet metal, such as tinplate, aluminium or its alloys.

13. An apparatus for making a tubular can body from a blank of sheet material having a pair of opposite co-extending rim portions, said apparatus comprising gripping means for gripping said rim portions, means for mutually moving the gripping means so as to bring the rim portions into adjacent positions, and means for interconnecting the rim portions of the blank by a seam so as to form the tubular can body, while a major intermediate portion extending between the rim portions remains unsupported, at least internally, wherein the means for mutually moving the gripping means is actuated by power driven means controlled by a controller in a way enabling re-defining the movement without mechanically reconfiguring of the apparatus.

14. An apparatus according to claim 13, wherein the means for mutually moving the gripping means are adapted to provide at least 2 linear degrees of freedom and at least one rotational degree of freedom of the gripping means.

15. An apparatus according to claim 13, further comprising a device for forming the tubular can body into a desired cross-sectional shape, said device including means defining a plurality of co-extending elongated contact surface parts for contacting the can body when inserted in the device such that the contact surface parts thereof each extends substantially axially in relation to the can body and adjacent to the inner or outer side surfaces thereof, and means for mutually moving the contact surface parts laterally into contact with the can body side surface or surfaces at peripherally spaced positions so as to peripherally extend the can body and impart the desired cross-sectional shape thereto.

16. An apparatus according to claim 15, further comprising a backing member arranged oppositely to one of said contact surface parts for gripping a longitudinally extending seam of the can body between said one contact surface part and the oppositely arranged backing member while the can body is extended peripherally.

17. An apparatus according to claim 15, wherein one or more of the contact surface parts is/are maintained substantially stationary in relation to the can body during said mutual lateral movement of the contact surface parts.

18. An apparatus according to claim 15, wherein all of said elongated contact surface parts are adapted to be located within the inner space of the tubular can body, at least one of the contact surface parts being movable transversely in relation to the other contact surface parts, so as to bring all of said contact surface parts into abutting engagement with the inner side surface of the can body.

19. An apparatus according to claim 15, wherein a first number of said elongated contact surface parts is adapted to be located in the inner space of the tubular can body and a second number of said elongated contact surface parts is adapted to be located outside the tubular can body, at least one of said first number of contact surface parts being movable laterally outwardly into contact with the inner side surface of the can body, and/or at least one of said second number of contact surface parts being movable laterally inwardly into contact with the outer side surface of the can body, so as to bring all of said contact surface parts into abutting engagement with the inner or outer side surface of the can body.

20. An apparatus according to claim 15, wherein each of the contact surface parts has a cross-sectional shape being substantially complementary to the desired cross-sectional shape of the respective one of said peripherally spaced positions of the can body.

21. An apparatus according to claim 15, wherein said contact surface parts are defined on a plurality of elongated, substantially co-extending rod-like members.

22. An apparatus according to claim 21, wherein the contact surface parts are defined by outer sleeve-like members each being removably mounted on a rod or shaft.

* * * * *

UNITED STATES PATENT AND TRADEMARK OFFICE

CERTIFICATE OF CORRECTION

PATENT NO. : 6,769,164 B2
DATED : August 3, 2004
INVENTOR(S) : Esad Zubcevic

It is certified that error appears in the above-identified patent and that said Letters Patent is hereby corrected as shown below:

Title page,
Item [22], PCT Filed:, change "Dec. 20, 2000" to -- Dec. 22, 2000 --.

Signed and Sealed this

Twenty-fourth Day of January, 2006

JON W. DUDAS
*Director of the United States Patent and Trademark Office*